United States Patent [19]

Mosca

[11] 4,406,219

[45] Sep. 27, 1983

[54] PARCEL TYING-UP MACHINE

[76] Inventor: Gerd Mosca, Gestüt Winterhauch, D-6935 Waldbrunn-Schollbrunn, Fed. Rep. of Germany

[21] Appl. No.: 253,528

[22] PCT Filed: Aug. 28, 1980

[86] PCT No.: PCT/EP80/00084

§ 371 Date: Apr. 15, 1981

§ 102(e) Date: Apr. 15, 1981

[87] PCT Pub. No.: WO81/00548

PCT Pub. Date: Mar. 5, 1981

[30] Foreign Application Priority Data

Aug. 30, 1979 [DE] Fed. Rep. of Germany ..... 2935028

[51] Int. Cl.[3] ..... B65B 13/04

[52] U.S. Cl. ..... 100/7; 53/588; 100/26

[58] Field of Search ..... 100/3, 33 PB, 7, 26, 100/178, 222; 198/343; 53/582, 588; 141/101, 135

[56] References Cited

U.S. PATENT DOCUMENTS 2,339,395 1/1944 Harvey ..... 100/27

3,577,909 5/1971 Takano ..... 100/26

FOREIGN PATENT DOCUMENTS 2341614 3/1975 Fed. Rep. of Germany ..... 100/7

2064466 6/1981 United Kingdom ..... 100/7

*Primary Examiner*—Billy J. Wilhite

*Attorney, Agent, or Firm*—Michael J. Striker

[57] ABSTRACT

A parcel tying-up machine which is placed between an input conveyor belt for the parcels to be tied up and an output conveyor belt for the tied-up parcels, comprises a frame and a tying-up unit. The tying-up unit has a guide apparatus for placing a tie round a parcel and a tie-joiner, which is placed under the conveyor path in the tying-up plane and is operative for joining together the loop ends of the tie. The tying-up unit is supported on the frame so that it may be moved backwards and forwards in the direction of transport of the parcels. The movement of the tying-up unit is affected by a driving system which is fixed to the frame. The machine is provided with conveying systems for taking over the parcels to be tied up from the input conveyor belt and for handing over the parcels after being tied up onto the output conveyor belt.

7 Claims, 9 Drawing Figures

PARCEL TYING-UP MACHINE

BACKGROUND OF THE INVENTION

The present invention concerns a parcel tying-up machine, which is to be placed between an input conveyor belt for the parcels to be tied up and an output conveyor belt for the tied-up parcels, with a frame and with a tying-up unit, which has a guide apparatus for placing the tie round a parcel, and a tie-joiner, which is placed under the conveyor path in the tying-up plane and is designed for joining together the loop ends of the tie.

Tying-up machines on these lines are known and are used more specially for tying up parcels of newspapers or periodicals, although they may be used for other parcels, tied up with synthetic a resin tape, cord or wire. If synthetic resin tape is used for tying up, the tie-joiner will be a welder, with whose help the ends of the loop placed round the parcel are welded together. On the other hand, if a cord is used for tying up, the tie-joiner will be a knotter for knotting together the ends of the loop placed round the parcel. If a wire is used for tying up, the tie-joiner may be a twisting unit with which the ends of the wire loop, threaded round the parcel, are twisted up together. If, on the other hand, a steel strap or band is used for tying up, the tie-joiner wil be a swaging unit with which the ends of the steel strap loop, placed round the parcel, are joined together by plastically bending them and possibly using a sheet metal sleeve.

In the case of parcel tying-up machines to date, the parcels, which are moved to the machine by a conveyor belt, have to be stopped, put into the tying-up position and after tying-up have to be pushed on to an output conveyor belt. Because of the braking of the parcels, tying them up and then starting them moving again, the transport of the parcels from one part of the apparatus to another is slowed down to a large degree, that is to say the conveyor belt may only be worked at a given rate of so many parcels in each unit of time as dependent on the rate at which the parcels may be tied up by the typing-up machine. For this reason, the spacing between the parcels on the input conveyor belt has to be generally large in size.

SUMMARY OF THE INVENTION

One purpose of the present invention is that of designing a parcel tying-up machine in the case of which it is not necessary for the parcels to be stopped for tying them up.

This purpose is effected in the invention in that the tying-up unit is supported so that it may be moved backwards and forwards in the frame in the direction of transport of the parcels and may be powered by a driving system, which is fixed to the frame and takes effect in two directions of motion and in that on the two sides of the tying-up plane on the tying-up unit at the level of the conveyor belt, conveying systems are present for taking over the parcels to be tied up from the input conveyor belt and for handing over the parcel after being tied up onto the output conveyor belt after motion of the typing-up unit in the direction of transport.

In the case of this tying-up machine, the parcels may be moved up to the tying-up machine with hardly any spacing between them or right up against each other. As soon as a parcel is in the tying-up position, the tying-up unit is moved generally with the same speed as the input conveyor belt in the direction of transport and, at the same time, the tying-up operation takes place. At the end of the motion of the tying-up unit, the tied-up parcel is handed over to the output conveyor belt and the tying-up unit is moved back to the input conveyor belt so that the next parcel may be taken up by it and tied up.

The tying-up unit with the guide apparatus, the tie-joiner and the conveying systems are placed on a carriage-like frame, which is able to be moved on a straight guide, positioned in said frame. The conveying systems on the moving tying-up unit may be rollers having free-wheels stopping them turning backwards. These rollers may be able to be turned freely so that the parcels are pushed from the input conveyor belt onto to the freely turning rollers of the tying-up unit. By using a stop, the tying-up position for the parcels on the tying-up unit may be fixed as desired. Because the rollers have free-wheels, the parcel is moved along by the tying-up unit, which itself is moving in the direction transport and, while this is taking place, the parcel is tied up. When the tying-up unit is sharply braked at the end of its motion, the tied-up parcel, supported on the rollers, designed for turning freely in the direction of transport, may go on moving in the transport direction because of its inertia till it is taken up by the output conveyor.

It is, however, furthermore possible for the conveyor systems of the tying-up unit to be powered. If such transport systems are rollers, the driving system for them has to be controlled in such a way that driving is stopped once the parcel has got as far as the tying-up station. As soon as the tying-up unit has taken up a position near to the output conveyor belt, the rollers may be put under power again so that the tied-up parcel is handed over to the output conveyor belt.

In the case of a specially useful form of the invention the transport systems are formed by at least one endless conveyor belt which is trained in line with the input conveyor belt over an inlet roller, supported on the frame, and over a first direction-changing roller, placed at the tying-up unit in front of the tying-up plane, and is then trained downwards round the tie-joiner of the tying-up unit over at least one direction-changing roller journalled on the tying-up unit, and is then trained upwards over a second direction-changing roller placed in line with the line of transport after the tying-up plane and journalled on the tying-up apparatus and is trained in line with the transport path over a run-off roller, journalled on the frame and then the idle run of the conveyor belt is trained back over at least one guide-back roller, supported on the frame under the tying-up unit, for motion back to the inlet roller.

Further details of the invention will be seen from the patent claims.

An account will now be given of a parcel tying-up machine of the invention using the working examples to be seen in the figures.

DETAILED DESCRIPTION OF THE PREFERRED EMBODIMENTS

Figure 1:
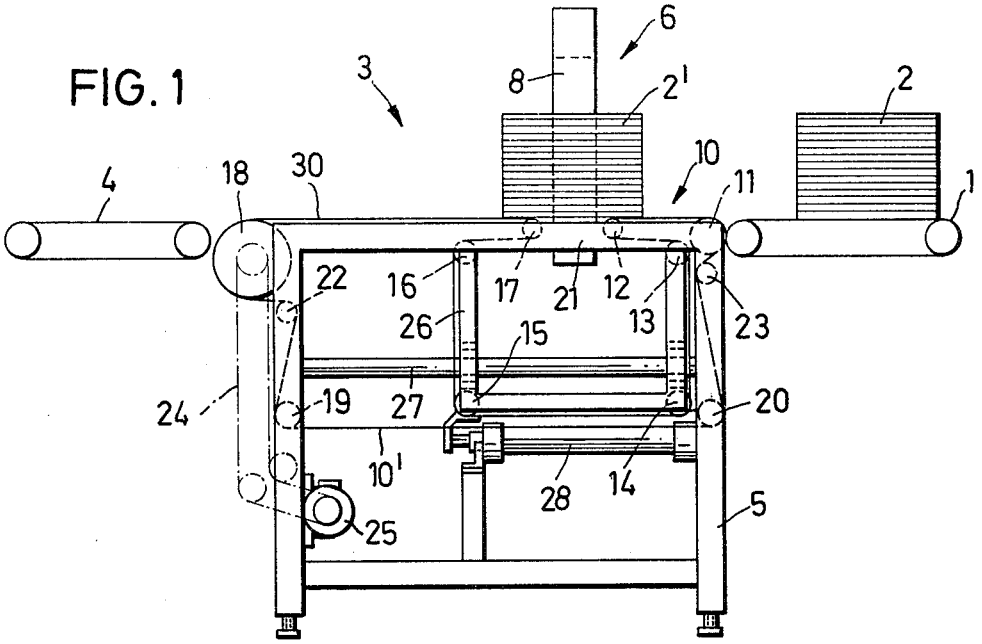
FIG. 1 is a side view of the parcel tying-up machine in a position or condition before tying up a parcel.
Figure 2:
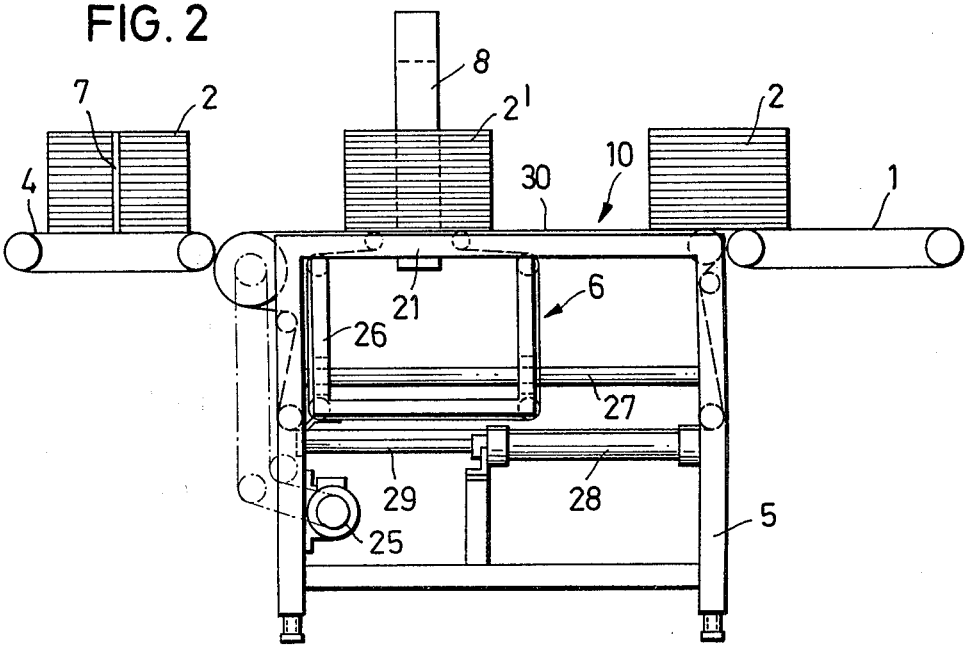
FIG. 2 is a side view of the parcel tying-up machine in the condition after tying up the parcel.

As will be seen FIGS. 1 and 2, parcels 2, for example parcels of newspapers or the like, are moved by an input conveyor belt 1 to a tying-up machine 3 and the tied-up parcels 2' are transported on further by an output conveyor belt 4. The tying-up machine 3 is made up of a frame 5 and a tying-up unit 6, supported in the frame so that it may be moved backwards and forwards in the direction of transport of the parcels 2. The tying-up unit 6 has a guide apparatus 8 for training the tie 7 round the parcel 2. Furthermore, the machine 3 has (see FIG. 3) a tie-joiner 9 for joining up the two ends of the loop, trained round the parcel 2, of tie.

If the tie is a welding-quality synthetic resin band, the tie-joiner will be a welding unit, while on the other hand, if the tie is a cord or the like, the tie-joiner will be a knotter. If the tie is in the form of wire, the tie-joiner will be a twisting unit for twisting up the ends of the loop of the wire. The guide apparatus 8 and the tie-joiner 9 are in the tying-up plane. On the two sides of the tying-up plane, at the same level as the transport path, transport systems 10 are placed at the sliding tying-up unit 6, such systems taking over the parcels 2, which are to be tied up, from the input conveyor belt 1 and, after the tying-up unit 6 has been moved in the transport direction, bending over the parcel 2, in the tied-up condition, onto the output conveyor belt 3.

In the working example to be seen, the conveying system 10 (or transport system) takes the form of a conveyor belt 30 which is trained over an inlet roller 11, a first direction-changing roller 12, a first top direction-changing roller 13, a first lower direction-changing roller 14, a second lower direction-changing roller 15, a second top direction-changing roller 16, a second direction-changing roller 17, a run-off roller 18, a first run-back roller 19 and a second run-back roller 20 in such a way that the parcel 2', positioned in the tying-up station, is supported on the two sides of the tying-up plane by the transport or conveyor belt 30, but between the two direction-changing rollers 12 and 17, a space 21 is kept, through which the tie 7 is moved and positioned in contact with the tie-joiner 9. One of the rollers 11 to 20 is a driving roller. Furthermore, rollers for pulling the conveyor belt 30 tight and guiding it (see 22,23 may be present. In the case of the working example of the invention to be seen, the run off roller 18 is designed as the driving roller and is powered by way of a chain 24 and an electric motor 25, fixed to frame 5, the speed of the roller 18 being the same as the transport speed of the two conveyor belts 1 and 4.

Figure 4:
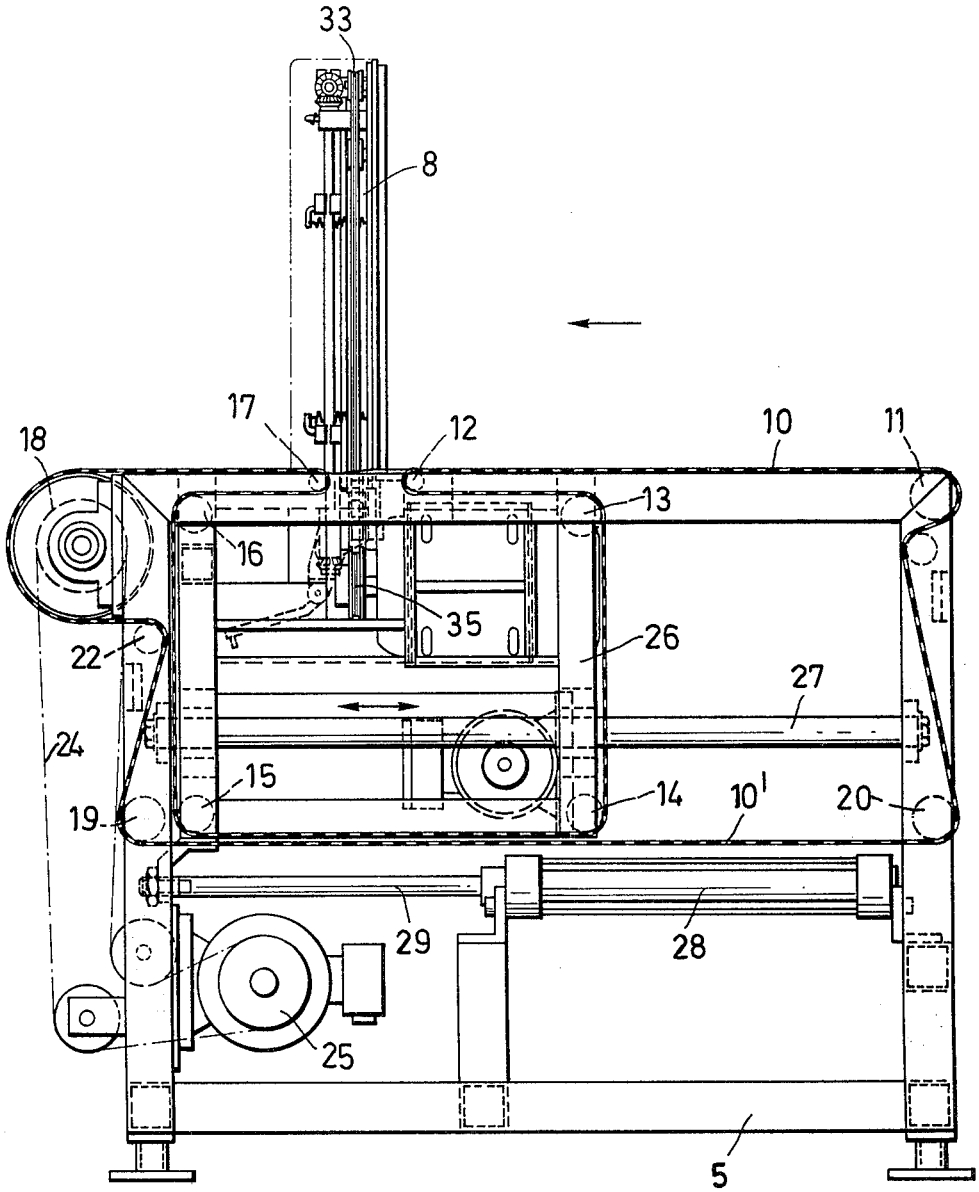
FIG. 4 is lengthways section view of the tying-up machine.

As will be more specially seen from FIGS. 1, 2 and 4, rollers 12 to 17 are supported on a frame 26 supporting the tying-up unit 6 with the guide apparatus 8 and the tie-joiner 9 and which is supported on a straight guide (fixed to frame 5) so that it may be moved backwards and forwards, the straight guide being made up of two guide rods 27, fixed in the frame 26. An air-power or hydraulic piston cylinder unit 28, placed so as to be parallel to the guide rods 27 in frame 5, and whose piston rod 29 takes effect on frame 26, is responsible for causing backward and forward motion of the tying-up unit 6. In place of a piston cylinder unit 28, it would furthermore be possible to have a motor-powered lead-screw driving system including a motor 28' and a lead-screw 29' operated by motor 28'. Driving system 28 is responsible for moving the tying-up unit in the transport direction with a speed, which is the same as the speed of transport of the conveyor belts 1 and 4. In this respect furthermore, the conveyor belt 30 of the tying-up unit 6 is moved with a speed which is the same as the transport speed of the conveyor belts 1 and 4 so that the parcels 2 are taken over without being slowed down or speeded up from the input conveyor belt 1, are moved on and, while this is being done, tied up, and the tied-up parcel 2' is handed over to the output conveyor belt 4. Because on motion of the tying-up unit 6 or of the frame 26, in the direction of transport the tying-up unit 6 and the conveyor belt 30 are moved at generally the same speed, the conveyor belt 30 is still in relation to the tying-up unit 6 so that, even though the conveyor belt 30 is moving on, the tying operation may be undertaken.

Figure 3:
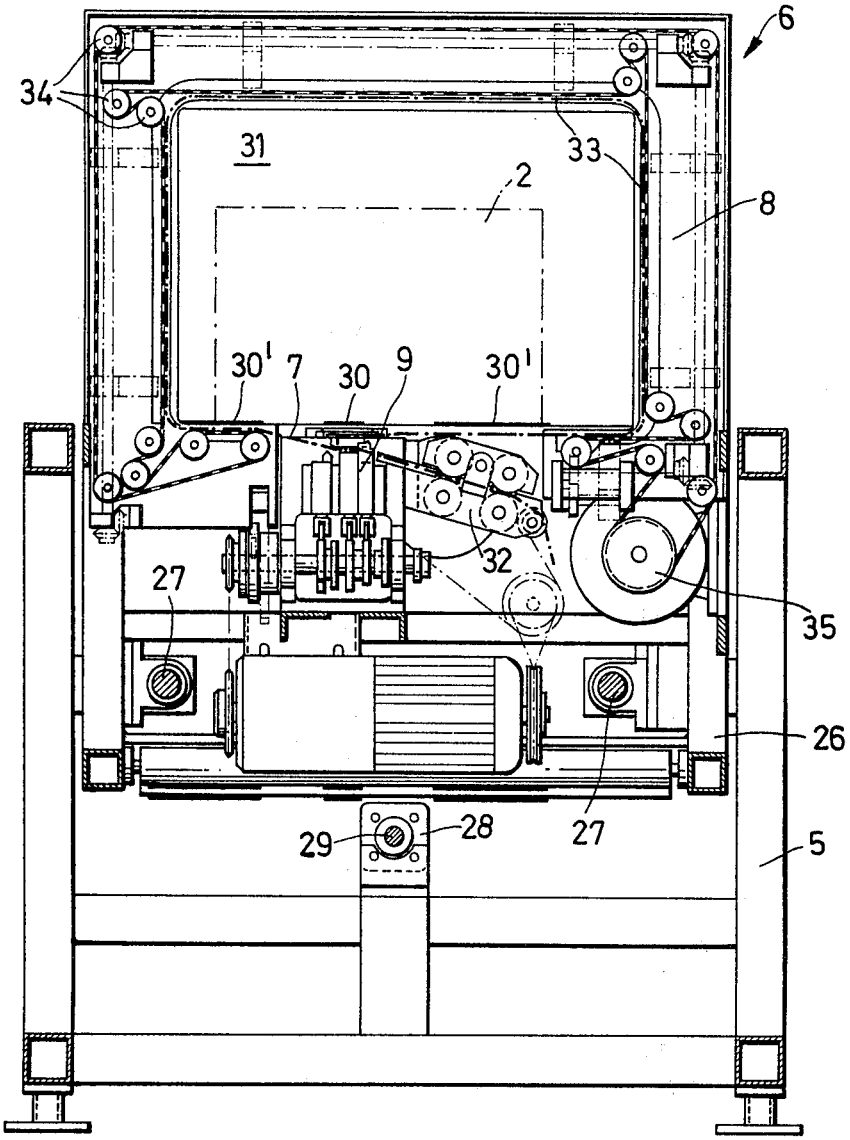
FIG. 3 is cross-section view of the tying-up machine.

As will be seen more specially from FIG. 3 as a tie 7, use is made of a synthetic resin band, whose loop ends are welded together or hot-sealed by the tie-joiner 9. The tie-joiner 9 is furthermore fitted with a cutter for cutting off the band loop, placed round the parcel 2, from the supply of band. The guide apparatus 8 has, in the present working example of the invention, a guide frame, skirting a rectangular opening 31 for the parcel 2. Under the support stage or plane for the parcel 2, there is, in the tying-up unit, a pull-off and threading-in unit 32 for the tie 7. The inner face, turned towards the parcel, of the guide frame, has a guide part into which the tie band 7 is threaded by way of the pull-off and threading-in unit so that the start of the tie 7 is trained round the parcel 2, the tie 7 forming a loop round the parcel 2, such loop being pulled tight, while the start of the band is gripped, and then joined or done up while being pulled tight. With the help of the joining and cutting unit 9, the start of the band is joined with the end of the loop and, more specially, welded and the loop so done up is cut off from the supply of band.

In the straight-line parts of the guide path, the same is formed by a driving belt 33, whose transport speed is the same as or higher than the speed with which the tie 7 is threaded in. Th driving belt 33 is an endless, flat belt, guided over guide rollers 34 and a driving wheel 35. In place of a frame-like guiding apparatus for the tie material, it will be possible, in a known way, to make use of a turning ring (see U.S. Pat. No. 2,339,395).

Figure 5:
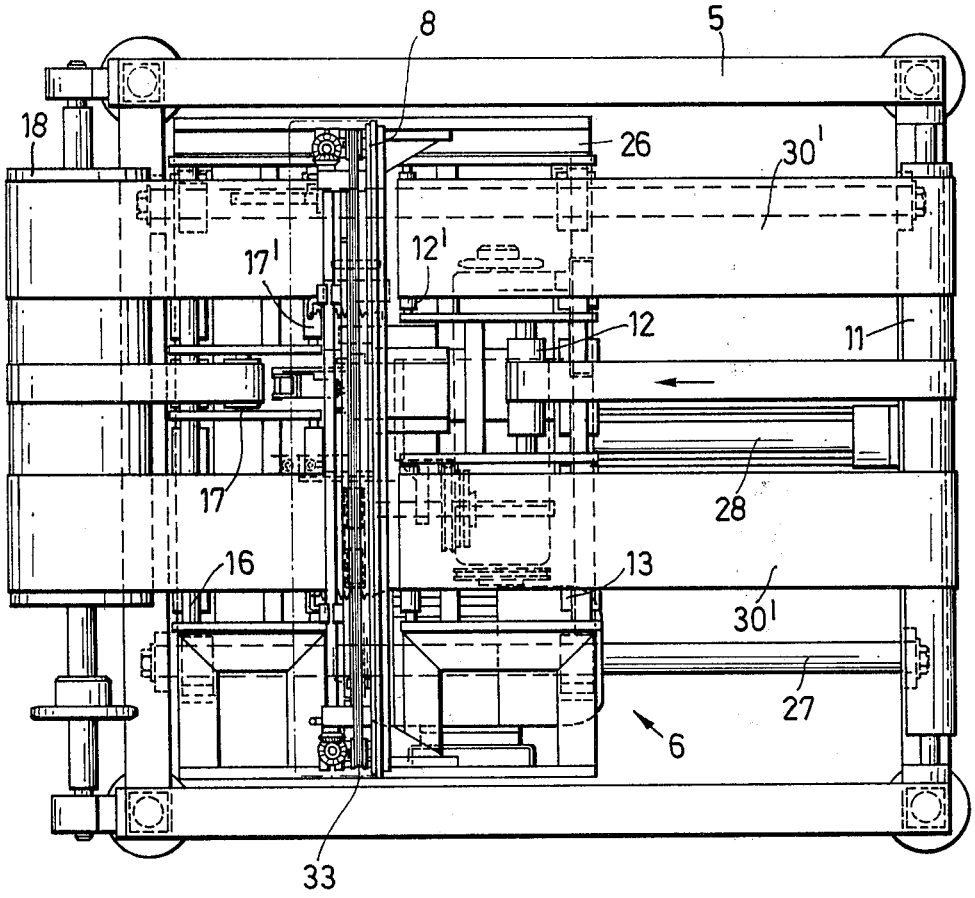
FIG. 5 is a top plan view of the tying-up machine.

As will be seen from FIG. 5, in place of only one single conveyor belt 30, it would furthermore be possible to make use of three conveyor belts 30, 30', the middle conveyor belt 30 on the two sides on the tying-up plane not coming so near to the tying-up plane as the two conveyor belts 30' to the side. The tying-up plane is in the plane of the driving belt 33.

In the case of the middle conveyor belt 30, the direction-changing rollers 12 and 17 are at a larger distance from the tying-up plane than the changing-direction rollers 12' and 17' of the side guide belts 30', because between them the tie-joining and cutting apparatus 9 has to be placed. The changing-direction rollers 12' and 17' of the side conveyor belts 30' are placed so near each other that the space between them is only large enough for moving the tie 7 therethrough. The side guide belts 30' are responsible for the useful effect that the parcel 2 is well supported in the typing-up position. The middle guide belt 30 is responsible for the useful effect that soft material which is not stiff, as for example newspapers, is supported well even in the middle.

In the case of the working example to be seen in FIGS. 3, 4 and 5, stacks of newspapers may be transported with a transport speed of 0.3 m/sec. and with a spacing about 0.3 m and thereby tied up. The distance moved by the tying up unit 6 is about 0.3 m. While the speed of motion of the tying-up unit 6 in the transport direction is about 0.3 m/sec., the speed moving backwards in the opposite direction is about 0.5 m/sec. The transport speeds may be even further increased largely and, furthermore, the spacing between the parcel 2 to be tied up may be decreased. The parcels 2 to be tied up may be taken up by the conveyor belts 30, 30' of the tying-up machine, while the parcel 2 coming before it is still in the tying-up station or is being handed over to the output conveyor belt 4. The tying-up operation is started by a sensing switch or a photocell.

Figure 6:
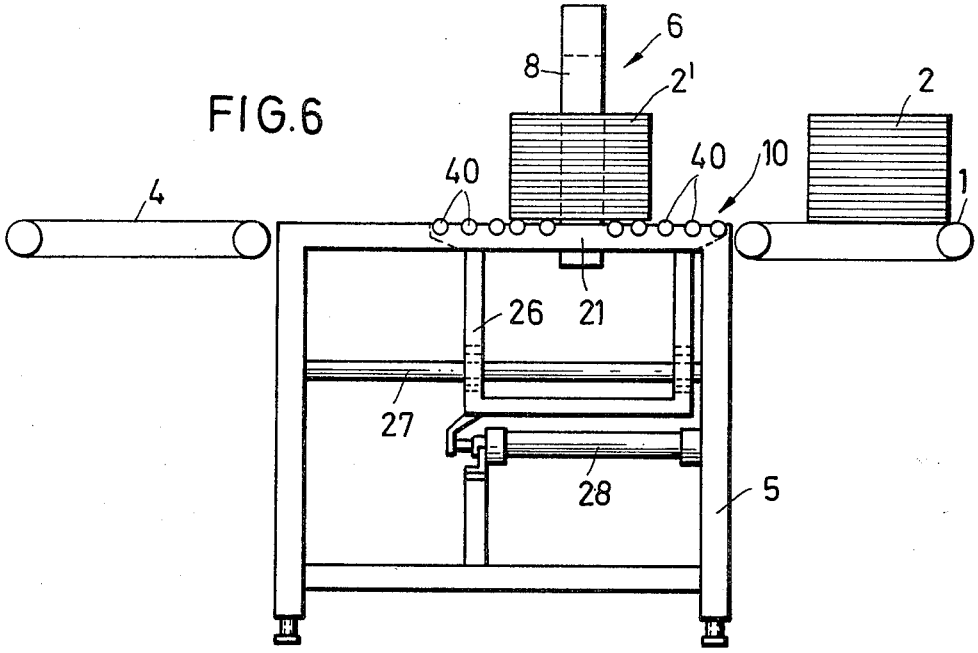
FIGS. 6 and 7 are side views of different forms of tying-up machines of the present invention.

FIG. 6 is a view of a working example of the invention in which all conveying systems of the tying-up unit are rollers 40, running freely in the direction of transport and having free-wheels for stopping them moving backwards. The input conveyor belt 1 is responsible for pushing the parcels 2 to be tied up into the tying-up station. Then, by the use of a sensing switch or a selenium cell or the like, the tying-up operation and the change in position of the tying-up unit 6 in the direction of transport is started. On braking the tying-up unit, the tied-up parcel 2 will go on moving, because of its own inertia onto the output conveyor belt. Between the rollers 40, placed short of the tying-up plane, and the rollers 40 coming thereafter there is a space or opening 21 to let the tie through.

Figure 7:
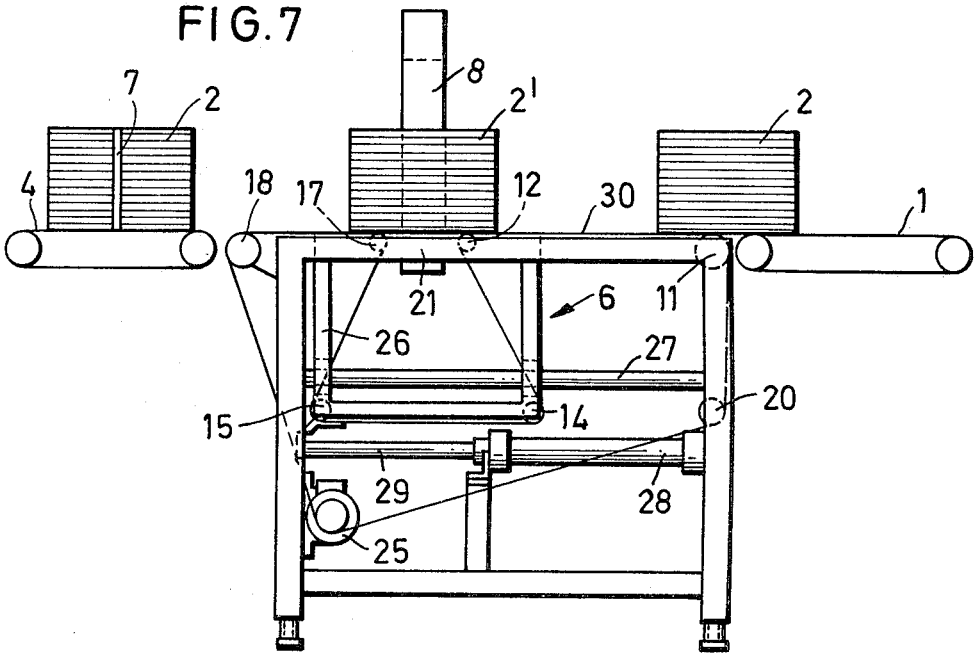
Figure 8:
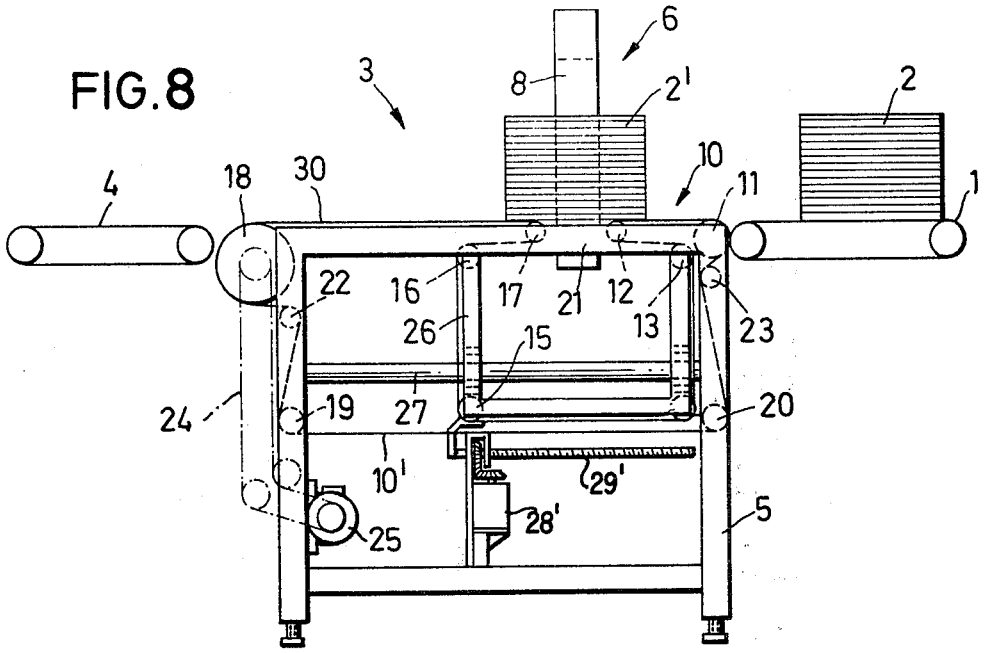
FIGS. 8 and 9 are side views similar to those of FIGS. 1 and 2 but with a motor-powered lead-screw driving system.
Figure 9:
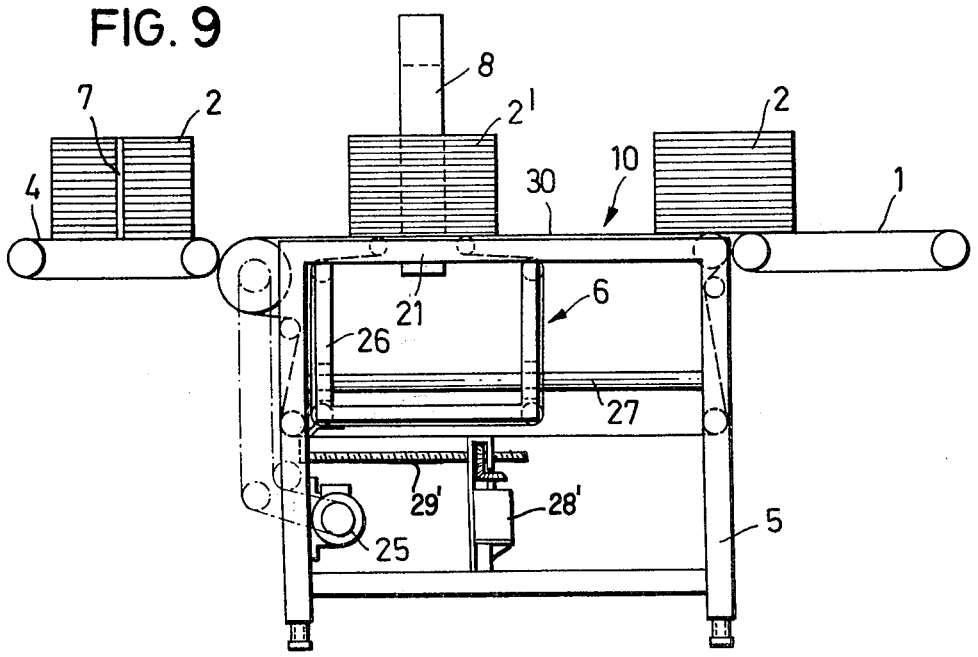

FIG. 7 is a view of a guiding system for the conveyor belt 30 in the case of which less direction-changing rollers are used than in the working example of FIGS. 1, 2 and 4.

I claim:

1. A parcel tying-up machine, comprising an input conveyor belt for the parcels to be tied up; an output conveyor belt for the tied-up parcels; and a parcel tying-up device positioned between the input conveyor belt and the output conveyor belt, said parcel tying-up device including a frame, a tying-up unit arranged on said frame for forward and backward motion to said output conveyor belt in the direction of transport of the parcels and to said input conveyor belt in the backward direction, said tying-up unit comprising a frame means, a guide apparatus located above said frame means and operative for placing a tie means round a parcel, a conveyor system placed on said frame means and providing a conveyor path for the parcels, a pull-off and threading-in unit positioned below said conveyor path and operative for starting a loop over the parcel, a tie joiner positioned in a tying-up plane for joining together loop ends of the tie means, drive means connected to said frame and operative for driving the tying-up unit in said forward and backward motion, and guide means for guiding said tying-up unit in said forward and backward motion, said conveyor system being operative for taking over a parcel from said input conveyor belt and for handing the parcel, after the latter has been tied up in said tying-up unit, onto said output conveyor belt after said tying-up unit has been moved in said transport direction, said conveyor system including at least one endless conveyor belt trained in line with said input conveyor belt, an inlet roller supported in said frame, a first direction-changing roller supported at the tying-up unit in front of the tying-up plane, at least one intermediate direction-changing roller supported on the tying-up unit, a second direction-changing roller supported on the tying-up unit after the tying-up plane, a run-off roller supported on said frame and at least one guide-back roller supported on said frame under said tying-up unit, said endless conveyor belt being trained over said inlet roller, over said first direction-changing roller, then downwards round said tie-joiner, over said intermediate direction-changing roller, then upwards over said second direction-changing roller and then over said run-off roller in said forward motion, said endless conveyor belt being trained back in the idle run off over said guide-back roller towards said inlet roller in said backward motion, said endless conveyor belt being driven with a speed equal to the speeds of said input conveyor belt and said output conveyor belt, said drive means being adapted to drive said tying-up unit in said forward motion with a speed equal to the speeds of said input conveyor belt and said output conveyor belt.

2. The machine as defined in claim 1, wherein said guide means include two parallel guide rods connected to said frame, said rods being round in cross-section.

3. The machine as defined in claim 2, wherein said conveyor system includes additional intermediate direction-changing rollers located on said frame means below said first direction-changing roller and second direction-changing roller, said first direction-changing roller being spaced from said second direction-changing roller along said conveyor path at a predetermined distance, said additional intermediate rollers being spaced from each other a distance greater than said predetermined distance.

4. The machine as defined in claim 3, wherein said drive means is a cylinder-piston unit.

5. The machine as defined in claim 3, wherein said drive means is a motor-powered lead-screw drive.

6. The machine as defined in claim 3, wherein said conveyor system further includes two side conveyor belts and side direction-changing rollers therefor, said endless conveyor belt being a middle conveyor belt located between said side conveyor belts, the side direction-changing rollers of the side conveyor belts being nearer to the tying-up plane than said first and second direction-changing rollers of said endless conveyor belt.

7. The machine as defined in claim 3, wherein said run-off roller is a driving roller powered by an electric motor fixed on said frame.

* * * * *